US005414967A

United States Patent [19]

Cates et al.

[11] Patent Number: 5,414,967

[45] Date of Patent: May 16, 1995

[54] CLEAN ROOM WALL SYSTEM

[75] Inventors: Dennis O. Cates, Lake Oswego; Randy Webb, Aurora; Roger Crawford, Salem; Ron Jackson, Monmouth; Mary K. Rossman, Wilsonville, all of Oreg.

[73] Assignee: Unistrut International Corp., Ann Arbor, Mich.

[21] Appl. No.: 139,388

[22] Filed: Oct. 19, 1993

[51] Int. Cl.[6] ..... E04B 7/00

[52] U.S. Cl. ..... 52/281; 52/241; 52/280

[58] Field of Search ..... 52/241, 242, 235, 280, 52/281, 282.1, 775

[56] References Cited

U.S. PATENT DOCUMENTS

| | | | |
|---|---|---|---|
| 3,566,561 | 3/1971 | Tozer | 52/880 X |
| 4,163,350 | 8/1979 | Doguchi et al. . | |
| 4,368,930 | 1/1983 | Worrallo | 52/280 X |
| 4,984,400 | 1/1991 | Bockmiller . | |
| 5,307,600 | 5/1994 | Simon, Jr. et al. | 52/241 |

FOREIGN PATENT DOCUMENTS

| | | | |
|---|---|---|---|
| 273515 | 2/1967 | Australia | 52/282 |
| 1160156 | 12/1963 | Germany | 52/281 |

OTHER PUBLICATIONS

U.S. patent application Ser. No. 07/894,499 filed Jun. 4, 1992.

Advertising Brochure for UCR240 and UCR200.

*Primary Examiner*—Carl D. Friedman
*Assistant Examiner*—Creighton Smith
*Attorney, Agent, or Firm*—Dykema Gossett

[57] ABSTRACT

A wall system for clean rooms employs an elongated framing member having four channels each with a thread slot in the bottom of the channel. This four channel arrangement facilitates the concealment of the fasteners and brackets used to join framing members to one another.

2 Claims, 4 Drawing Sheets

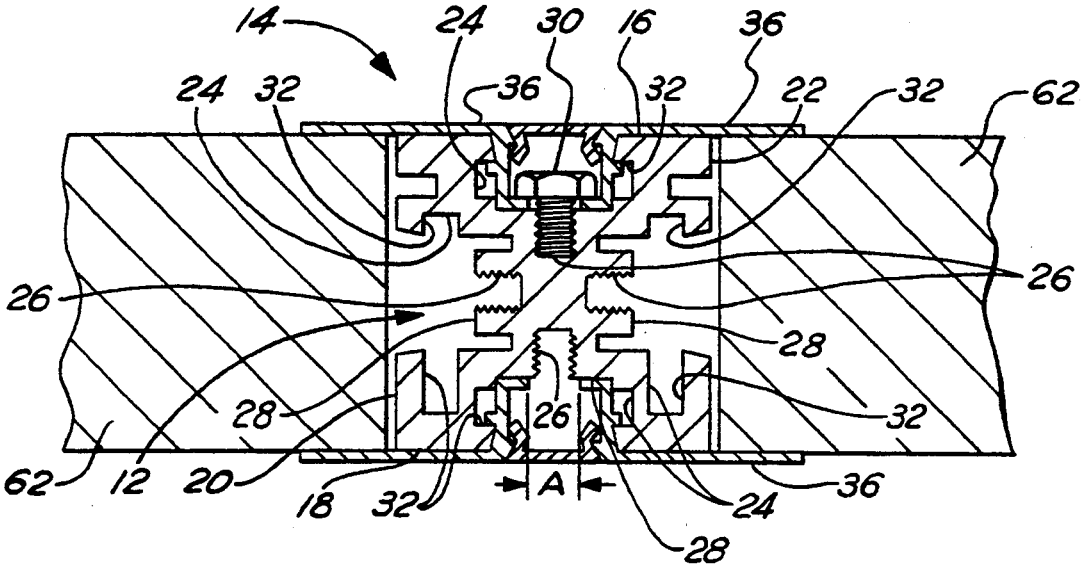
FIG. 1
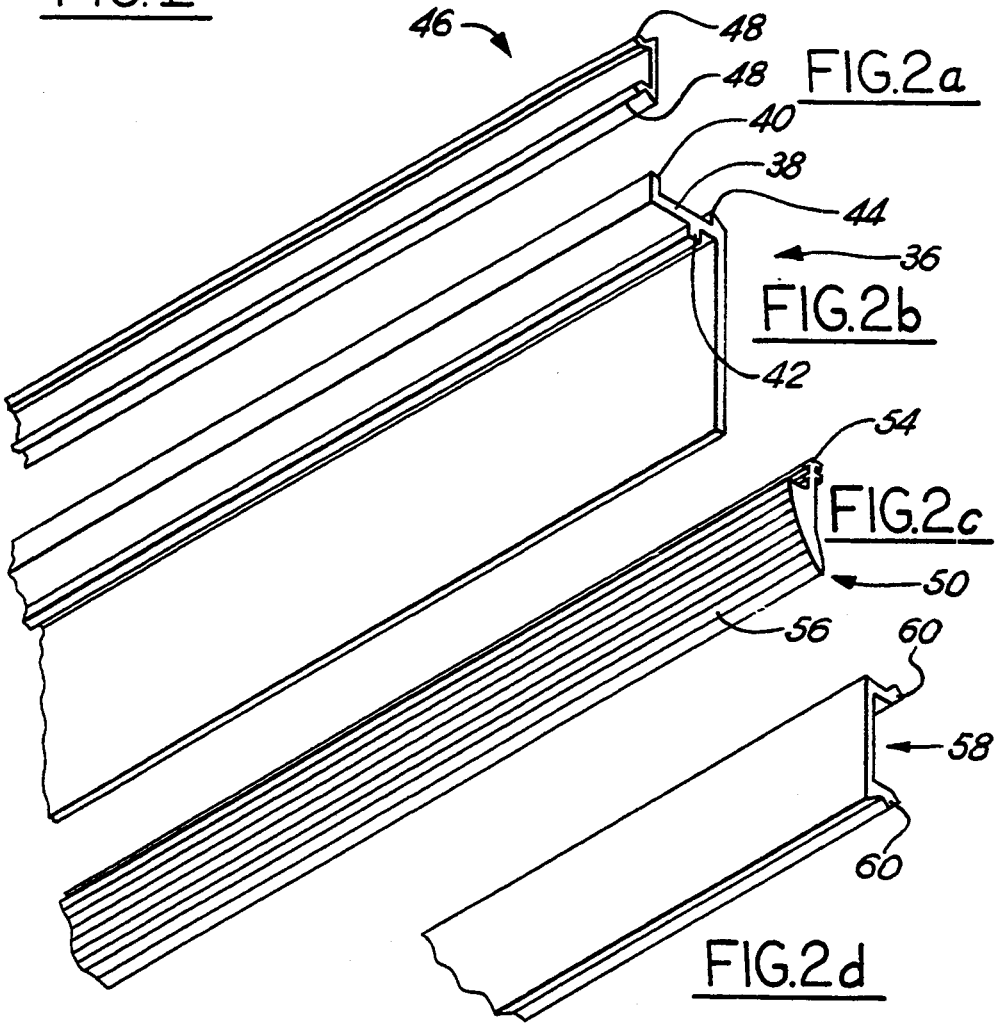
FIG. 2a
FIG. 2b
FIG. 2c
FIG. 2d

CLEAN ROOM WALL SYSTEM

FIELD OF THE INVENTION

This invention relates to non-progressive wall systems for clean rooms. More specifically it relates to the framing of walls.

BACKGROUND OF THE INVENTION

Processing operations requiring very clean environments, such as the manufacture of semiconductor devices, require the construction and use of a clean room to provide a suitably clean environment. Using conventional construction techniques and materials to erect walls generates an objectionable amount of contamination of the work space by airborne particles and other debris. Removing and altering conventionally constructed walls would also result in an undesirable amount of contamination to the clean room. The materials chosen for clean room construction are relatively dust free, such as aluminum, which can be handled and formed without generating much dust or debris. Non-progressive wall construction systems with framing members capturing wall panels are commonly used for clean rooms. They allow walls to be erected with a minimum of cutting and drilling, and also permit removal of single panels in a continuous wall without removing adjacent panels. Almost all sizing and cutting of the wall components can be done outside of the clean room area.

Some clean room wall systems, however, have the disadvantage of only being suited for use as a clean room wall on one side of the assembled wall. Another concern is with the ease of assembly of the walls. Some wall systems require a high degree of manual dexterity to assemble the panels into the supporting frame members. Nuts must be suspended in a slot with one hand, while trying to align a bracket and thread a bolt into the nut with the other hand. Yet another concern with present clean room wall systems is the number of special components and frame member brackets used to accommodate joints between walls such as inside corners and outside corners. The proliferation of parts for a system dramatically increases the cost of producing that system.

SUMMARY OF THE INVENTION

The present invention employs four-channel framing members with each channel having a thread slot. The invention also employs two-piece panel retainers in place of conventional one-piece panel retainers. The two-piece panel retainers are separated by a gap which is aligned with the thread slot. This provides 100% access to the thread slots, thereby minimizing any need to align elements during assembly. Two-piece panel retainers also facilitate the removal of the panel retainers and panels with minimal affect on adjacent panels. The two-piece retainers of the present invention completely eliminate the need present with one-piece retainers to drill through the center of the retainer so screws can pass through the retainer and threadingly engage the thread slot. The resultant 100% access greatly enhances the ease of both installing the retainers and mounting hang-on attachments, such as work stations. Screws can pass directly through a mounting hole in the hang-on attachment and into the threaded slot.

L-shaped clip angles are also advantageously employed in the present invention. The clip angles recess into the channel for concealment therein. Screws pass through the clip angles and into the framing member thread slots, thereby attaching and positioning the two frame members being joined at a right angle.

The present invention also employs a moment connection in combination with clip angles to support and align two framing members abutting a first framing member with each other. The moment connection and clip angle combination provides a wall section joining four panels together at a single point with no bracketry exposed except for a small portion of the moment connection. This allows for the removal of a lower section of a wall below a chosen elevation, while leaving the upper wall section structurally intact.

DESCRIPTION OF THE DRAWINGS

FIG. 1 is a sectional view of a straight run of a wall system with thick panels.

FIG. 2*a* is a pictorial view of a closure strip.

FIG. 2*b* is a pictorial view of a panel retainer.

FIG. 2*c* is a pictorial view of a glazing spline.

FIG. 2*d* is a pictorial view of a closure strip.

DESCRIPTION OF THE PREFERRED EMBODIMENT

Figure 3:
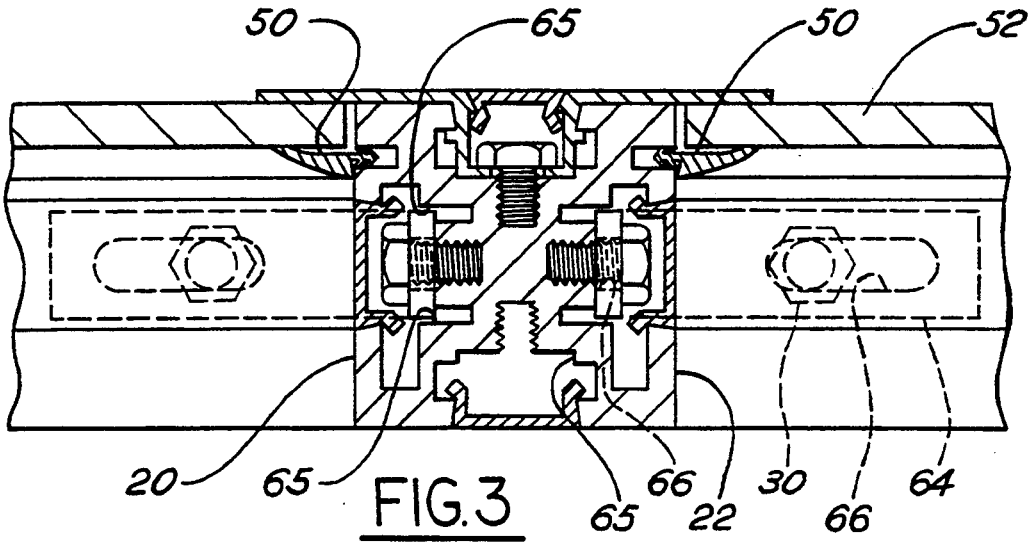
FIG. 3 is a sectional view of a straight run of a wall system with thin panels.

Central to a non-progressive wall system 10 of the present invention is a framing member 12 or a stud seen throughout the figures in cross-section. The framing member 12 has an elongated body 14 and a generally square cross-section, and in this embodiment is an aluminum extrusion. Each of four sides or surfaces 16, 18, 20, 22 of the framing member 12 is preferably approximately two inches wide. Each surface 16, 18, 20, 22 has a channel 24 recessed into that surface and a thread slot 26 recessed into a bottom surface 28 of that channel. The thread slots 26 have continuous grooves or teeth configured to accommodate a standard threaded fastener, or screw 30. Each of the surfaces 16, 18, 20, 22 overlap the channel 24 therein to define engaging shoulders 32 facing the bottom surface 28 of the channel 24 on either side of the channel 24. An overlapping portion of the surfaces 16, 18, 20, 22 tapers inward toward the engaging shoulders 32.

For purposes of reference, the four surfaces 16, 18, 20, 22 of the framing member 12 are characterized as a front surface 16, an opposed rear surface 18, a first side surface 20 between the front and rear surfaces 16 and 18 and a second side surface 22 opposed to the first side surface 20. These surfaces 16, 18, 20, 22 are principally distinguished from one another by the presence of two glazing spline receptor slots 34. One glazing spline receptor slot 34 is disposed in the first side surface 20 between the channel 24 therein and the front surface 16. The other glazing spline receptor slot 34 is disposed in the second side surface 22 opposite the first glazing spline receptor slot 34 between the channel 24 and the front surface 16.

A panel retainer 36 has a leg 38 adapted to extend into one of the channels 24 of the framing member 12. The leg 38 has features directed to the positioning and retention of the retainer 36 in the channel 24. A foot 40 at a bottom of the leg 38 extends inward along the bottom surface 28 of the channel 24 toward but not over the thread slot 26, thereby remaining clear of the thread slot 26. An engaging lip 42 extends outward from the leg 38 at approximately its mid point for engagement with the engaging shoulder 32 of the channel 24. A barbed edge 44 extends inward at a top of the leg 38.

Typically two retainers 36 will be employed on a single side of a framing member 12. A resultant gap A between the panel retainers 36 provides 100% access to the thread slot 26, allowing screws 30 to be located at any distance from each other without drilling. As shown in FIG. 1, two such panel retainers are oppositely disposed in the channel 24 in the front surface 16 and are retained by a plurality of screws 30 engaging the thread slot 26.

A first closure strip 46 is adapted for disposition between two panel retainers 36. The closure strip 46 has barbed edges 48 for engaging the barbed edges 44 of the panel retainers 36. The closure strip 46 is installed by pressing it into the gap A between the panel retainers with sufficient force to deflect the edges 48 of the closure strip 46 inward. The installed closure strip 46 is approximately flush with the panel retainers 36. The closure strip 46 covers the channel 24 and the screws 30, forming a pair of longitudinal seams.

Glazing splines 50 are used to help retain relatively thin aluminum panels 52, preferably approximately one quarter of an inch thick, to the framing member. In the embodiment shown in FIG. 3, a panel 52 is pressed against an outside of one of the panel retainers 36 and approximately abutting the framing member 12. The qualification of "approximately" abutting is used because the panel will typically be smaller than the area defined by the framing members, to allow it to fit therewithin. "Approximately" abutting is intended to include the abutting but—for a gap relationship between the panels and framing members. An outside surface of the panel is approximately aligned with the receptor slot, as the receptor slot is located a distance from the front surface approximately equal to the plate thickness. The glazing spline 50 is placed on the panel 52 at the framing member 12 and a barbed tip 54 of the glazing spline 50 pressed into the glazing spline receptor slot 34. A body 56 of the glazing spline 50 resultantly presses the panel 52 against the outside of the panel retainer 36.

A second closure strip 58 larger than but similar in construction to the first closure strip 46 is placed into the channel 24 in the rear surface 18 with barbed edges 60 engaging the shoulders 32 of the channel 24. The larger size of the second closure strip 58 makes the presence of panel retainers 36 unnecessary for the retention of the second closure strip 58. Similarly, second enclosure strips 58 are used in the channels 24 in the first side surface 20 and the second side surface 22.

Thick panels 62 shown in FIG. 1 are approximately equal in thickness to the framing members, and are commonly made of honeycomb section aluminum sandwiched between two thin aluminum plates. The thick panel 62 is pressed against the panel retainers 36. A second pair of panel retainers 36 are disposed in the channel 24 in the rear surface 18 opposite those in the channel 24 in the front surface 16 to sandwich the thick panel 62. Glazing spline is not needed to hold the thick panels. The first closure strip 46 is disposed between the two panel retainers 36 on the rear surface 18.

To completely frame-in a rectangular panel, four framing members 12 are joined to produce a rectangular shape. The framing members 12 are joined at right angles by L-shaped clip angles 64. The clip angles 64 are of such a width so as to easily fit into the channels 24 thereby contacting the bottom surface 28 of those channels 24 and are laterally positioned by guide sides 65. The clip angles 64 have apertures 66 in each leg to accommodate screws 30 passing through the clip angles 64 and into the thread slots 26 for fixing the clip angles 64 to the bottom surface 28 of the channels 24. The thread slot 26 allows the use of screws 30 to fix the clip angles 64 in place without the use of nuts and any manipulation thereof. Neither is any drilling required. One framing member 12 would merely be butted up against another framing member 12, a clip angle 64 disposed in the intersecting channels 24 thereof and clamped in place by the tightening of screws 30 passing into the thread slots 26. This process would be repeated at each of the four corners of the enclosing framing members 12 into which a panel 52, 62 is to be placed.

For thin panels 52, second closure strips 58 would then be placed in the channels 24 in the side surfaces 20 and 22 over the clip angles 64, thereby concealing the clip angles 64. With thick panels 62, the installation of second closure strips 58 over the clip angles 64 would be unnecessary, as the clip angles 64 and channels 24 would be concealed by the panel 62.

Figure 6:
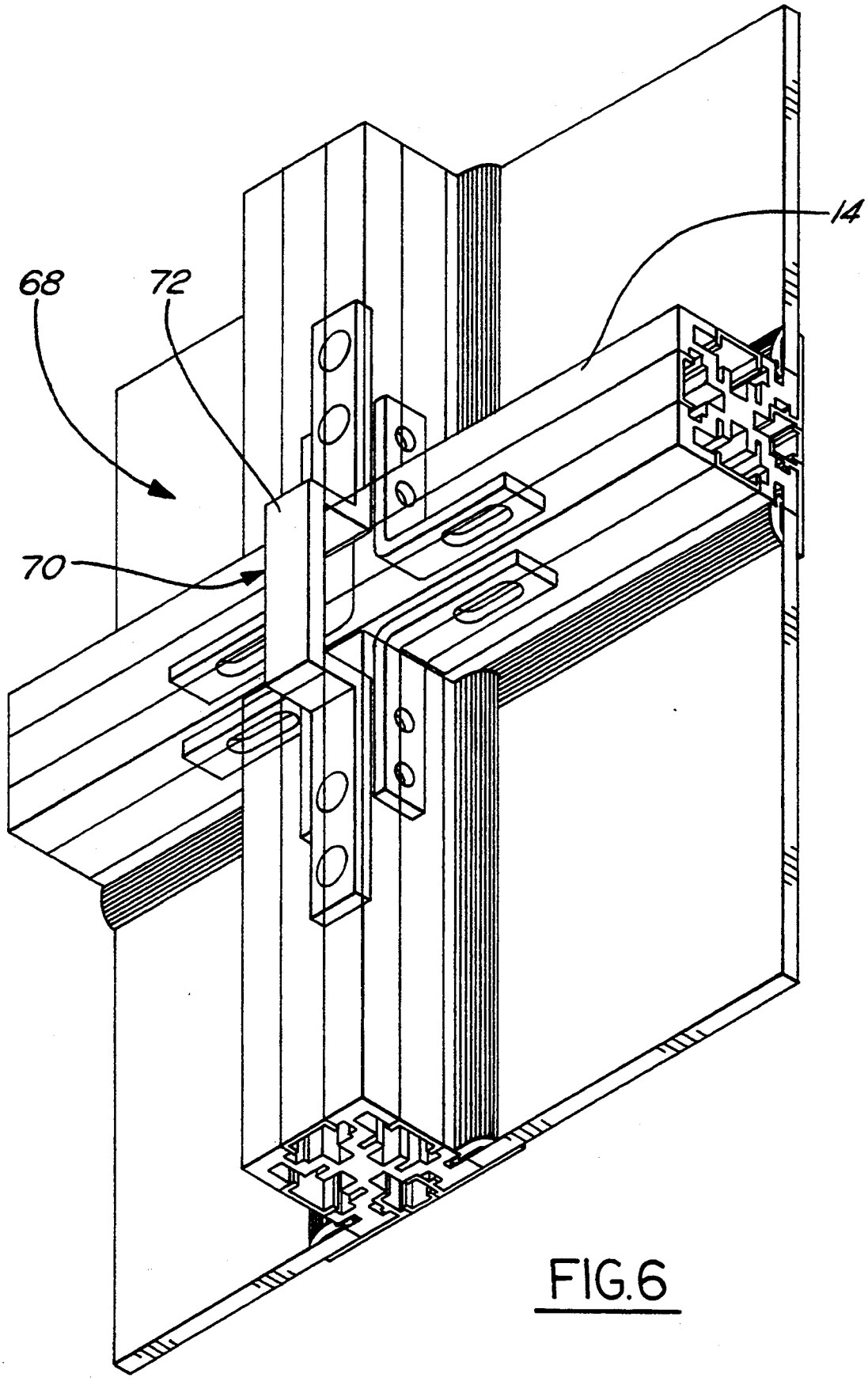
FIG. 6 is a pictorial view of a moment joint connection.

A moment joint 68, shown in FIG. 6, is employed to join together four panels 52, 62 at a common point. The moment joint 68 effects an intersection between three framing members 12. A continuous first framing member **12*a* is intersected by a second framing member 12*b* abutting one of the sides of the framing member. A third framing member 12*c* abuts the first framing member 12*a* opposite the second framing member 12*b* and is aligned therewith. Four L-shaped clip angles 64 are disposed in the channels 24 in the side surfaces 20 and 22 of the abutting framing members 12*b* and 12*c* and retained therein by screws 30 to hold the second and third framing members 12*b* and 12*c* at right angles to one another. A moment connection 70 has a U-shaped portion 72 with outwardly extending flanges 74 having fastener apertures therein. The flanges 74 are disposed in the channels 24 in the rear surface 18 of the second and third framing members 12*b*, 12*c* and are held therein by screws 30 with the U-shaped portion 72 wrapping around the first framing member 12*a*. The moment connection provides the joint with improved bending strength yet remains nearly concealed relative to the framing members 12*a*, 12*b*, 12*c***.

Figure 4:
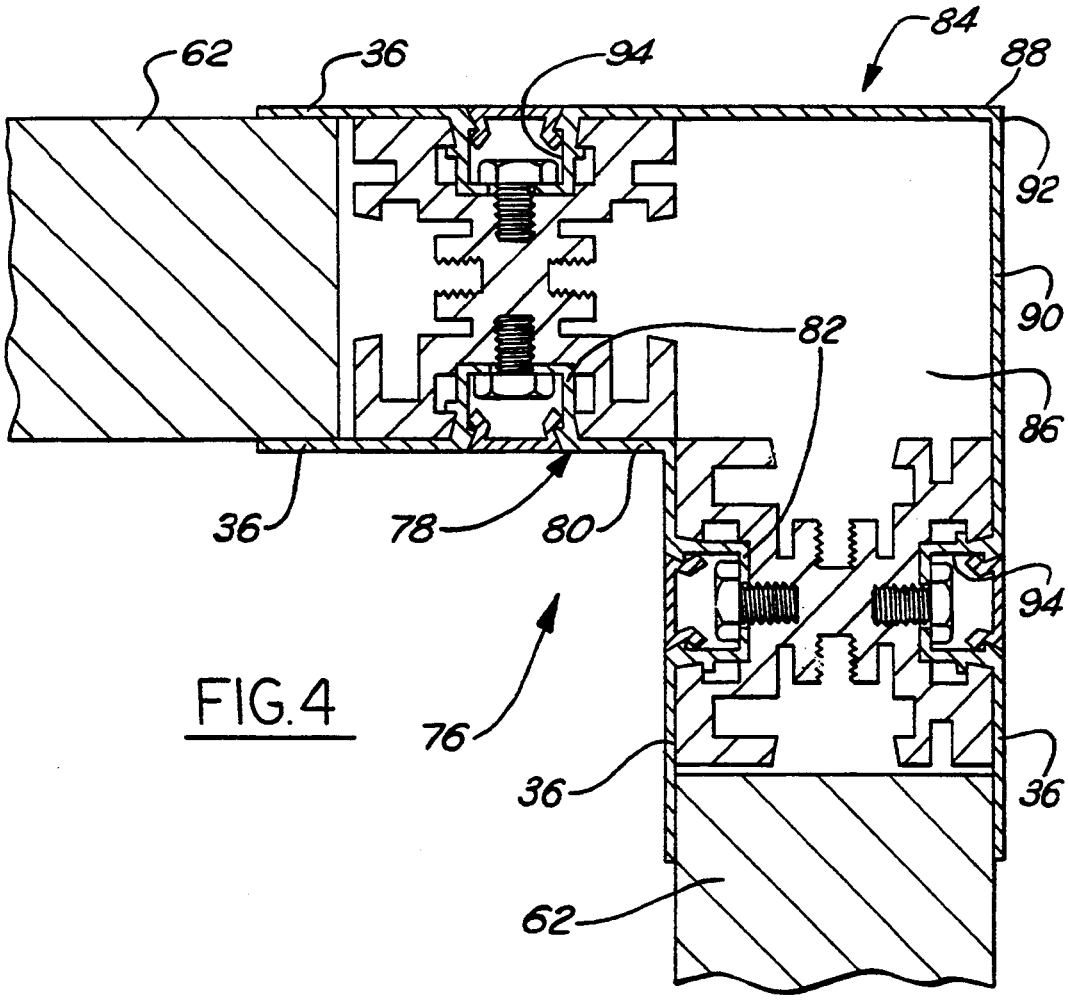
FIG. 4 is a sectional view of a corner with thick panels.
Figure 5:
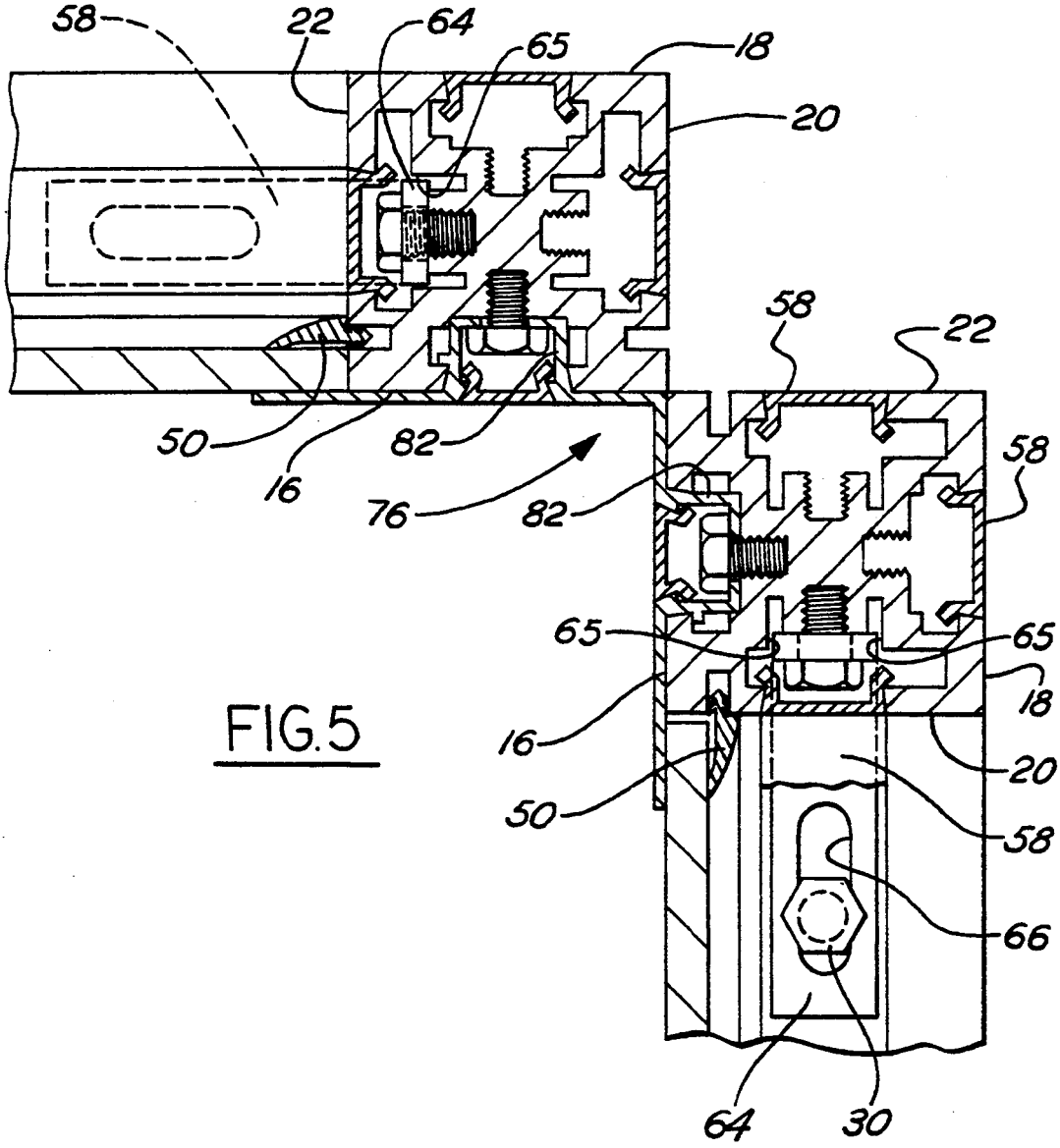
FIG. 5 is a sectional view of an inside comer with thin panels.

Inside and outside corners are formed using two diagonally juxtapositioned framing members as shown in FIG. 4 and FIG. 5. An inside corner 76 between walls is shown in FIG. 4 and FIG. 5. An inside corner retainer 78 links two diagonally juxtapositioned framing members 12 wherein one surface 16, 18, of one framing member 12 cooperates with one surface 16, 18, of the other to form the inside corner 76. The inside corner retainer 78 has a right angle portion 80 for disposition between the two cooperating surfaces of the framing members 12. Two legs 82, one on each end of the right angle portion 80, extend into the channels 24 of the cooperating surfaces. Both legs 82 are similar in shape to the leg 38 of the panel retainer 36. The inside corner retainer 78 and an associated panel retainer 36 are held in the channel 24 by a common screw. A first closure strip 46 covers the channel and the screws 30 as is done with the panel retainers 36.

An outside corner retainer 84 as shown in FIG. 4 encloses a void 86 between the two diagonally juxtapositioned framing members 12. Cooperating surfaces 16 of the framing members 12 define an imaginary outside corner 88. It is a right angle portion 90 and the outside corner retainer 84 which defines an outside corner 90 coincident with the imaginary outside corner 88. The outside corner retainer 84 has legs 94 which extend down into the channels 24 of the cooperating surfaces 16. These legs 94 are also similar to the legs 38 of the conventional panel retainers 36. A conventional panel retainer 36 is also disposed in the channels 24 of the cooperating surface 16 opposite the outside corner retainer 84. Screws 30 threading into the thread slots 26 hold the panel retainers 36 and the outside corner retainer 84 in the channel 24. A first closure strip 46 is placed between the panel retainer 36 and the outside corner retainer 84 to enclose the channel 24 and cover the screws 30.

The advantages of the present invention are readily apparent. The provision of four screw bosses, or thread slots 26, facilitates assembly by eliminating the need to maneuver or position fasteners and also by making any drilling unnecessary. The provision of the thread slots 26 in the bottom of channels 24 provides the further advantage of allowing the screws 30 to be concealed within the channels 24, which is clearly superior to having the exposed fastener heads as in the prior art right angle connections between framing members 12. The use of two-piece or split panel retainers 36 and corner retainers 78, 84 allows access to 100% of the thread slots 26 facilitating the location of hang-on accessories without drilling of the panel retainers 36 to access the thread slots. Overhead cabinets (not shown) can be hung on the wall by merely passing screws 30 through the back of the cabinet and into the thread slots 26.

A further advantage of the disclosed system is that a framing member can be alternatively used with a thick panel 62 to divide two clean rooms, or with a thin panel 52 to divide a clean room from a chase/utility area.

Additionally, vertical extensions of walls can be made using the moment joint 68 of the present invention with only a portion of the moment connection 70 equalling its thickness protruding from the resultant wall. No fasteners are exposed. All fasteners are concealed in the channels 24 of the framing member 12.

The system 10 also allows the construction of inside and outside corners 76 and 92 without special corner frame members. Corner retainers allow two standard framing members 12 of the present invention to be used for corners 76 and 92. Elimination of the need to tool for, manufacture, and store special corner pieces provides an appreciable cost savings.

It should be appreciated that the scope of this invention is not limited to the above-described preferred embodiment. It is anticipated, for example, that the panel retainers 36, framing members 12, and panels 52, 62 could be constructed of material other than aluminum. Framing members have been made of fiberglass reinforced plastic, and panel retainers have been made of vinyl. It is also anticipated that single framing members 12 could be used to provide comers for walls.

I claim:

1. A wall system for clean rooms comprising:

a first framing member for retaining structural panels having an elongated body with a generally square cross-section defined by a front surface and an opposed rear surface and a first side surface and an opposed second side surfaces, a front channel recessed into the front surface, a front threaded slot recessed into a bottom surface of the front channel, a rear channel recessed into the rear surface, a rear thread slot recessed into a bottom surface of the rear channel, a first side channel recessed into the first side surface, a first side thread slot recessed into a bottom surface of the first side channel, a second side channel recessed into the second side surface a second side thread slot recessed into a bottom surface of the first side channel, a first glazing spline receptor slot in the first side and disposed between the first side channel and the front surface, and a second glazing spline receptor slot in the second side opposite the first glazing spline receptor slot and disposed between the second side channel and the front surface;

a second framing member substantially identical to the first framing member abutting one of the first and second sides of the first framing member;

a third framing member substantially identical to the first framing member abutting the other of the first and second sides of the first framing member and aligned with the second framing member;

four L-shaped clip angles with fastener apertures and each disposed both in part in the side channel of the first framing member and in part in one of the second and third member second channels and being retained therein by screws engaging the corresponding thread slots; and a moment connection having a U-shaped portion and outwardly extending flanges with fastener apertures therein with the flanges disposed in the rear channels of the second and third framing members and held therein by screws and with the U-shaped portion wrapping around the first framing member whereby the moment connection is nearly concealed within the framing members.

2. A wall system for clean rooms comprising:

a framing member for retaining structural panels having an elongated body with a generally rectangular cross-section, a first surface forming one side of the elongated body, a first channel recessed into the first surface, and a first thread slot recessed into a bottom surface of the first channel;

a first panel retainer being elongated and disposed in part in the first channel and extending outward from the first channel to beyond an adjacent side;

a second panel retainer being elongated and disposed in part in the first channel separated from the first retainer panel by a gap and extending outward from first the channel and away from the first panel retainer; and a plurality of threaded fasteners passing between the panel retainers and engaging the thread slot, thereby retaining the retainers.

* * * * *